United States Patent [19]

Haas

[11] Patent Number: 4,465,125

[45] Date of Patent: Aug. 14, 1984

[54] HEAT EXCHANGE UNIT PIN

[75] Inventor: Rudy E. Haas, East Syracuse, N.Y.

[73] Assignee: Carrier Corporation, Syracuse, N.Y.

[21] Appl. No.: 202,982

[22] Filed: Nov. 3, 1980

[51] Int. Cl.[3] ..... F28F 7/00

[52] U.S. Cl. ..... 165/76; 165/125; 411/510; 403/408; 403/167

[58] Field of Search ..... 411/508, 510; 403/406, 403/408; 165/76–78, 122, 125; 285/19

[56] References Cited

U.S. PATENT DOCUMENTS

| | | | |
|---|---|---|---|
| 878,353 | 2/1908 | Compton | 285/19 |
| 2,048,246 | 7/1936 | Dasher | 165/125 X |
| 3,978,919 | 9/1976 | Fashbach | 165/125 X |
| 4,318,208 | 3/1982 | Borja | 411/508 |

FOREIGN PATENT DOCUMENTS

| | | | |
|---|---|---|---|
| 81748 | 11/1920 | Fed. Rep. of Germany | 285/19 |

*Primary Examiner*—William R. Cline
*Assistant Examiner*—Theophil W. Streule
*Attorney, Agent, or Firm*—Donald F. Daley; Robert P. Hayter

[57] ABSTRACT

Apparatus for use in a heat exchange unit for securing a heat exchanger assembly to the remaining components of the unit. A pin which acts to secure a tubular member and a lateral support to either a fan assembly or a base pan is disclosed. This pin has an insertion portion having pin teeth which is inserted into a tube for securing the pin to the tube, a spacer portion for locating in a fixed relationship a lateral support relative to the heat exchange unit and a top portion for securing the pin to the component to which it is being fastened.

10 Claims, 4 Drawing Figures

HEAT EXCHANGE UNIT PIN

BACKGROUND OF THE INVENTION

1. Field of the Invention

The present invention relates to heat exchange units. More specifically, the present invention relates to a pin for use in affixing a heat exchange assembly to the remaining portions of a heat exchange unit.

2. Prior Art

Wound fin heat exchangers are well known in the refrigeration and air conditioning field. A wound fin heat exchanger consists of tubes having a fin material wrapped about the tube in heat exchange relation therewith to promote heat transfer between fluid flowing through the tube and a separate fluid flowing over the tube. Utilization of this type of heat exchanger, wound fin, has been found to be both cost effective and to provide appropriate heat transfer with a minimum of tube length. A type of wound fin tubing includes slit fin tubing wherein a sheet of fin material is slit laterally and then rolled to a generally U-shaped arrangement such that the non slit portion is wound against the tube and the slit portions extend outwardly therefrom.

To make advantageous use of wound fin heat exchangers it is necessary that the heat exchanger be configured to optimize heat transfer. Once the appropriate configuration is ascertained the wound fin tubing should then be maintained in that configuration for the life of the heat exchanger. A combination heat exchange assembly comprising a tube support, and a tube may be used to secure the wound fin heat exchanger in the desired configuration. This combination heat exchange assembly may also be used as an integral part of a heat exchange unit such that it may be fastened to a base pan and to other assemblies of the heat exchange unit.

The herein disclosed apparatus includes a pin being specifically adapted to secure the tube of the heat exchanger assembly to either the base pan or fan assembly of the heat exchange unit. The pin has a very specific construction to allow for both securing the pin to the interior surfaces of the tube as well as securing the pin to the other components of the heat exchange unit while spacing same and while providing a structural support for the heat exchange assembly.

SUMMARY OF THE INVENTION

It is an object of the present invention to provide apparatus for supporting wound fin tubing in an appropriate heat exchanger configuration.

It is a further object of the present invention to provide a pin for structurally connecting a heat exchanger assembly to another component of a heat exchange unit and for securing a tube support to a support tube.

It is a further object of the present invention to provide a heat exchange unit having structurally supporting components assembled with a pin of a particular configuration.

It is a still further object of the present invention to provide a pin for utilization with a heat exchange assembly for securing that assembly within a heat exchange unit.

It is yet another object of the present invention to provide a heat exchange unit which is easy to assemble, reliable, economical and easy to maintain.

Other objects will be apparent from the description to follow and the appended claims.

The above objects are achieved according to the preferred embodiment of the invention by the utilization of a pin to connect the heat exchange assembly to other portions of the heat exchange unit. The pin has an insertion portion generally cylindrical in configuration and having projecting teeth extending therefrom for engagement with the interior surface of the tube. Connected to the insertion portion, the pin has a spacer portion having a diameter greater than the diameter of the tube and greater than the diameter of an opening in a lateral portion of the tube support. Likewise the spacer portion has a greater diameter than the opening in the component to which the heat exchanger assembly is to be fastened such as a base pan or fan assembly. Connected to the spacer portion of the pin is a top portion having two pieces suitably extending therefrom such that they may be compressed to allow insertion through the opening in the base pan or fan assembly and thereafter expanding providing a support lip for engaging the material of the base pan or fan assembly securing same to the spacer portion of the pin. This pin further serves to secure the tube within an opening in the lateral portion of the tube support in a spaced relation to the opening in the fan assembly or base pan.

DESCRIPTION OF THE PREFERRED EMBODIMENT

The embodiment as described herein is adapted for use in a heat exchanger assembly having a base pan and a fan assembly supported in relation to each other by the tube support described. The pin is utilized to secure the heat exchange assembly to either the base pan or the fan assembly. This pin may be used to secure only the heat exchange assembly to the base pan or to the top assembly or both. This pin securing arrangement will be likewise applicable to other configurations of heat exchangers and to securing tubular components to flat metal components in other arrangements.

Figure 1:
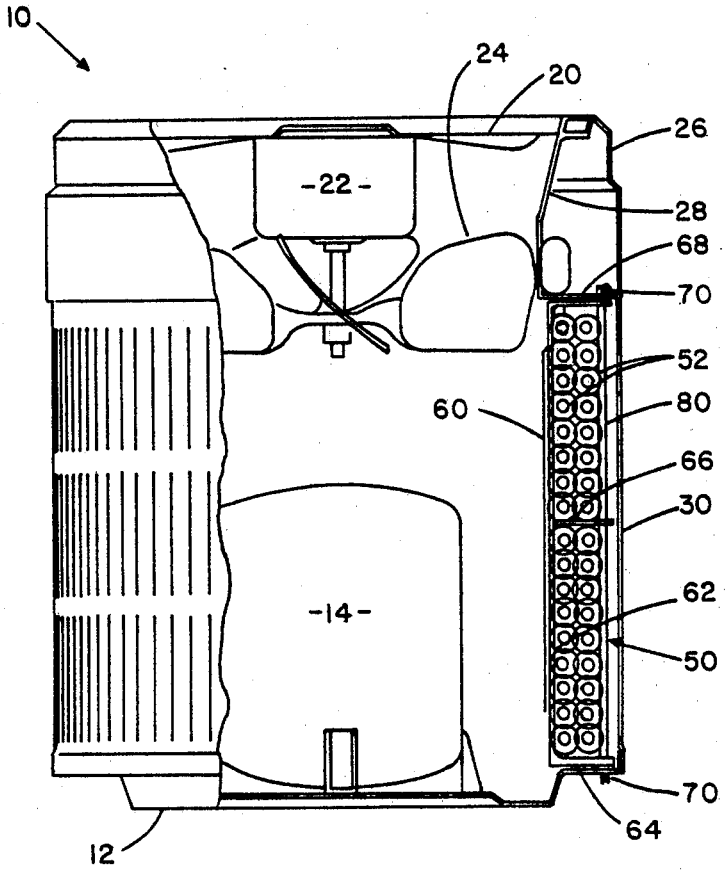
FIG. 1 is a sectional view of the heat exchange unit incorporating the tube support assembly and pin as disclosed herein.

Referring to FIG. 1 there can be seen a heat exchange unit incorporating a heat exchanger assembly. Heat exchange unit 10 has base pan 12 to which the remainder of the components are mounted. Base pan 12 has a compresser 14 mounted in the center thereof and wound fin heat exchanger 50 mounted about the circumference of the unit. Heat exchanger 50 is formed by winding a long wound fin tube in to a generally cylindrical configuration. Each revolution of the tube is referred to as a run herein to indicate that the wound fin tubing may be continuous about the heat exchanger. Referring to each run as a part of the heat exchanger is without delineation as to the number of circuits or other parameters within the heat exchanger.

Tube support 60 is shown having a vertical portion 62, and lateral portions including top lateral portion 68, bottom lateral portion 64 and central lateral portion 66. Each lateral portion extends outwardly from the vertical portion and has an opening therein through which support tube 80 passes. Pin 70 is inserted into each end of the support tube 80 such that the pin secures the support tube and tube support 60 to the base pan 12 at the bottom and to fan orifice 28 at the top. At the upper portion of the heat exchange unit fan orifice 28 is shown as an annulus on or about the unit with top cover 26 dropping thereover to form a fan assembly. As used herein, the fan assembly shall include fan orifice 28, top cover 26 as well as any other components suspended therefrom such as grille 20, fan motor 22 and fan 24. During operation of this type of heat exchange unit, ambient air to be conducted through the heat exchange unit in heat exchange relation with the refrigerant flowing through the heat exchanger is drawn through wrapper 30 encasing the heat exchanger, through heat exchanger 50 and is then discharged through grille 20 at the top of the unit. Fan motor 22 and fan 24 are supported from grille 20 which is mounted to cover the opening in the center of top cover 26. Fan orifice 28 and top cover 26 serve to define a region at the top of the unit wherein electrical controls unit may be secured. The fan orifice additionally defines an air flow pattern with fan 24 to promote efficient air flow through the unit.

Figure 2:
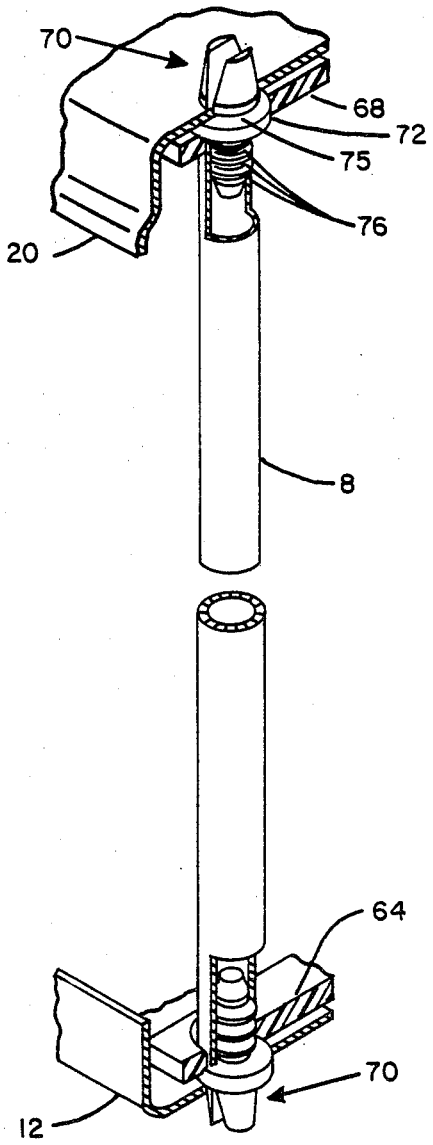
FIG. 2 is a cut away sectional view of a portion of the heat exchanger assembly.

FIG. 2 shows an enlarged view of the manner in which various components are secured by pin 70. At the top of FIG. 2 it can be seen that tube 80 is partially cut away such that pin teeth 76 extending circumferentially about the insertion portion of the pin are shown engaging the interior surface of tube 80. Top lateral support 68 is shown having an opening through which the insertion portion of the pin extends. The pin spacer portion 72 is shown controlling the distance between fan orifice 28 and the top lateral support 68. Pin support lip 75 located at the bottom of the top portion of the pin contacts the upper surface of fan orifice 28 and spacer portion 72 contacts the bottom surface of fan orifice 28 securing the fan orifice therebetween.

At the bottom of FIG. 2 it can be seen that second pin 70, identical in configuration to the first pin in the upper part of FIG. 2 performs the same function. Tube 80 extends through the opening in bottom lateral support 64. Pin 70 acts to secure base pan 12 between the support lip and the spacer portion of the pin to secure tube 80 of the heat exchanger assembly to the base pan.

Figure 3:
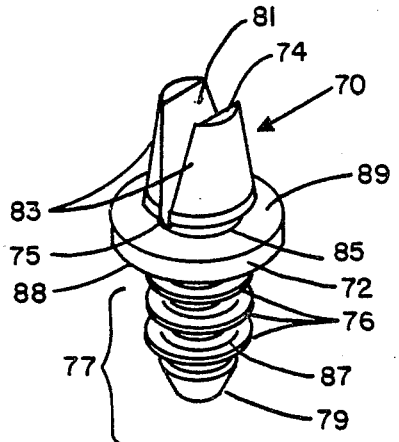
FIG. 3 is an isometric view of an embodiment of the pin.

FIG. 3 is an isometric view of pin 70. Pin 70 has an insertion portion, spacer portion and a top portion. The insertion portion 77 is generally cylindrical in configuration and has a tapered end 79. The insertion portion is adapted to fit within tube 80 and has extending circumferentially thereabout pin teeth 76. Cylindrical body portion 87 of the insertion portion is sized to readily slip within tube 80 with only the extending pin teeth contacting the interior surface forming a friction fit. The pin is formed from a flexible but resilient material such as plastic.

Pin spacer portion 72 is connected to insertion portion 77 and top portion 74. The spacer portion has a diameter greater than the diameter of the opening in either the lateral supports 64 or 68 or the opening in the fan orifice 28 or base pan 12. Pin spacer 72 is a sufficient thickness to provide the appropriate spacing between the lateral support and the component to which the end of the heat exchanger assembly is being secured. The bottom contact surface 88 of the pin spacer portion contacts the top of top lateral support 68 or the bottom of bottom lateral support 64 to maintain the lateral support in position relative to the end of tube 80. This bottom contact surface acts to secure the end of tube 80 and the exterior surface of the lateral support relative to each other. The top surface of the spacer portion engages the bottom of fan orifice 28 or the top of base pan 12.

Top portion 74 of pin 70 is formed from two top halves 83. Each top half is a portion of a cylinder which defines a top slot 81 therebetween. This top slot is of sufficient dimension that the two top halves may be compressed to allow them to be inserted through the opening in the fan orifice or base pan. Once inserted through that opening, the top halves expand to the original configuration. A narrow portion 85 is formed as a part of pin top 74 and is that portion in which either the fan orifice 28 or base pan 12 rests. Pin support lip 75 at the bottom of the top halves 83 contacts fan orifice 28 or base pan 12 on one side and the spacer top contact surface 89 contacts the fan orifice or base pan on the opposite side thereby securing the fan orifice or base pan therebetween.

Figure 4:
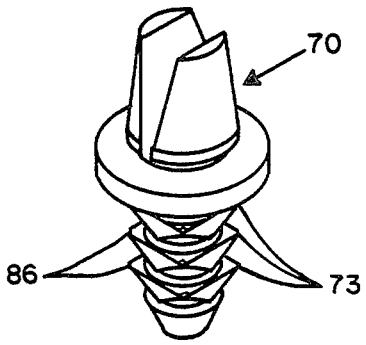
FIG. 4 is an isometric view of another embodiment of the pin.

FIG. 4 shows an alternative embodiment of the pin. In FIG. 4 pin teeth 76 are shown having spaced points thereabout for engagement with the interior surface of the tube. Either configuration may be suitable for the use herein. These pin points are designated 86 in FIG. 4.

Upon assembly of a heat exchange unit incorporating a heat exchanger assembly with pins 70, the wound fin heat exchanger is first placed in the tube support and then tube 80 is inserted through the openings in the lateral support portions of the tube support to secure the wound fin tubing in place. The unit is then assembled by securing the heat exchange assembly to the base pan. The bottom pin 70 is inserted through the bottom lateral support into tube 80 affixing the end of tube 80 relative to the bottom lateral support. The top portion of the pin is then compressed such that the whole heat exchange assembly is slid downwardly with pin 70 eventually expanding such that the pin support lip engages the base pan to secure the heat exchange assembly relative thereto. The fan assembly, including fan orifice 28, may then be assembled in the unit by first placing pin 70 into tube 80 such that the top lateral support 68 and tube 80 are secured thereby. The pin 70 is then compressed as fan orifice 28 is slid thereover and upon complete downward motion the top of the pin is allowed to expand such that pin support lip 75 engages the top of fan orifice 28. At this point the fan assembly is secured to the heat exchanger assembly which is secured to the base pan such that the unit is structurally complete. Multiple tube supports with tubes and pins are usually spaced about the unit to provide for structural integrity.

This pin further allows for disassembly of a heat exchange unit for service or other purposes. The top portion of the pin may be compressed to disengage the pin from the fan orifice or the base pan to allow the heat exchange assembly to be removed therefrom.

The invention herein has been described with reference to a particular embodiment of a pin adapted to secure a heat exchanger assembly to either a base pan or a fan assembly. It is to be understood that variations and modifications can be effected within the spirit and scope of this invention and that applications of this pin may include similar uses.

What is claimed is:

1. A fastener for securing a tube and a support defining a tube receiving opening relative to a member having a fastener receiving void which comprises:

an insertion portion having a body portion of less cross sectional distance than the inside diameter of the tube and at least one tooth extending outwardly from the body portion and having a diameter greater than the inside diameter of the tube to allow a press fit between the tooth of the fastener and the inside surface of the tube;

a spacer portion connected to the insertion portion, said spacer portion having a diameter greater than the inside diameter of the receiving opening of the support which is greater than the inside diameter of the tube, said spacer portion having a bottom contact surface for engaging the support and a top contact surface for engaging the member; and a top portion connected to the spacer portion having a narrow portion with a cross sectional width less than the width of the void in the member and a pair of top pieces forming a support lip for engaging the opposite side of the member from the side of the member engaged by the spacer portion, said top pieces being compressible to allow them to be passed through the void in the member.

2. The apparatus as set forth in claim 1 wherein the tooth of the insertion portion comprises a series of spaced parallel circumferentially extending annular teeth each adapted to engage the interior surface of the tube.

3. The apparatus as set forth in claim 1 wherein the insertion portion includes a series of spaced outwardly extending teeth each having spaced points about the circumference thereof, the points being adapted to engage the interior surface of the tube.

4. The apparatus as set forth in claim 1 wherein the two pieces of the top portion of the pin define a V-shaped void therebetween such that the two pieces may be compressed together allowing the top portion to pass through the fastener receiving void in the member.

5. The apparatus as set forth in claim 4 wherein the insertion portion including the body portion is formed such that the body portion has a tapered end thereon to promote insertion into the tube.

6. A heat exchange unit which comprises:

a base pan defining at least one opening;

a heat exchanger assembly including a heat transfer surface, a tube support and a tubular support member coacting with the tube support to secure the heat exchanger; and a pin for securing the heat exchanger assembly to the base pan, said pin having an insertion portion with at least one tooth which is inserted into the tubular support to engage same, a spacer portion connected to the insertion portion having a diameter greater than the tubular support and greater than the diameter of the opening in the base pan, and a top portion having a securing lip, said top portion being adapted to be inserted through the opening in said base pan to allow the securing lip to engage substantially peripherally the base pan, whereby said pin secures the heat exchanger assembly to the base pan.

7. The apparatus as set forth in claim 6 wherein the heat exchange unit additionally comprises a fan assembly mounted to the heat exchanger assembly, said fan assembly including an opening; and another pin identical to the pin for securing the base pan to the heat exchange assembly for securing the fan assembly to the heat exchange assembly.

8. The apparatus as set forth in claim 6 wherein the pin has a series of spaced circumferential teeth of a diameter greater than the inside diameter of the tubular support.

9. The apparatus as set forth in claim 6 wherein the pin top portion comprises a pair of top pieces capable of being inserted through the opening in the base pan and including a support lip for engaging the base pan, said top portion being compressible for assembly or disassembly.

10. The apparatus as set forth in claim 6 wherein the pin insertion portion includes a plurality of pin teeth each having spaced points for engagement with the interior surface of the tube.

* * * * *